United States Patent [19]

Alheid

[11] 4,398,494

[45] Aug. 16, 1983

[54] END DAM SEAL FOR BLADE TYPE FOUNTAIN COATERS

[75] Inventor: Robert J. Alheid, Beloit, Wis.

[73] Assignee: Beloit Corporation, Beloit, Wis.

[21] Appl. No.: 344,997

[22] Filed: Feb. 2, 1982

[51] Int. Cl.[3] ..... B05C 5/02

[52] U.S. Cl. ..... 118/410; 118/413

[58] Field of Search ..... 118/407, 410, 413; 101/207, 363, 208, 364, 210; 427/356, 358

[56] References Cited

U.S. PATENT DOCUMENTS

| | | | |
|---|---|---|---|
| 2,918,899 | 12/1959 | Munton et al. | 118/413 |
| 3,348,526 | 10/1967 | Neubauer | 118/410 |
| 4,250,211 | 2/1981 | Damrau et al. | 427/356 |
| 4,327,662 | 5/1982 | Damrau | 118/410 |

*Primary Examiner*—John P. McIntosh

*Attorney, Agent, or Firm*—Hill, Van Santen, Steadman & Simpson

[57] ABSTRACT

An end dam sealing means for at least one end of a coating application chamber defined in part by a doctor blade and backing surface means such as a roll on which a web to be coated travels continuously, is adapted for engaging sealingly with a chamber surface area, the doctor blade and the backing surface means roll, and the sealing means has a device for draining coating material that may migrate from the application chamber between the sealing means and the backing surface means roll. Static seal is provided for the contiguous end of a pressure drop chamber and a slit orifice which communicate with the coating application chamber.

20 Claims, 7 Drawing Figures

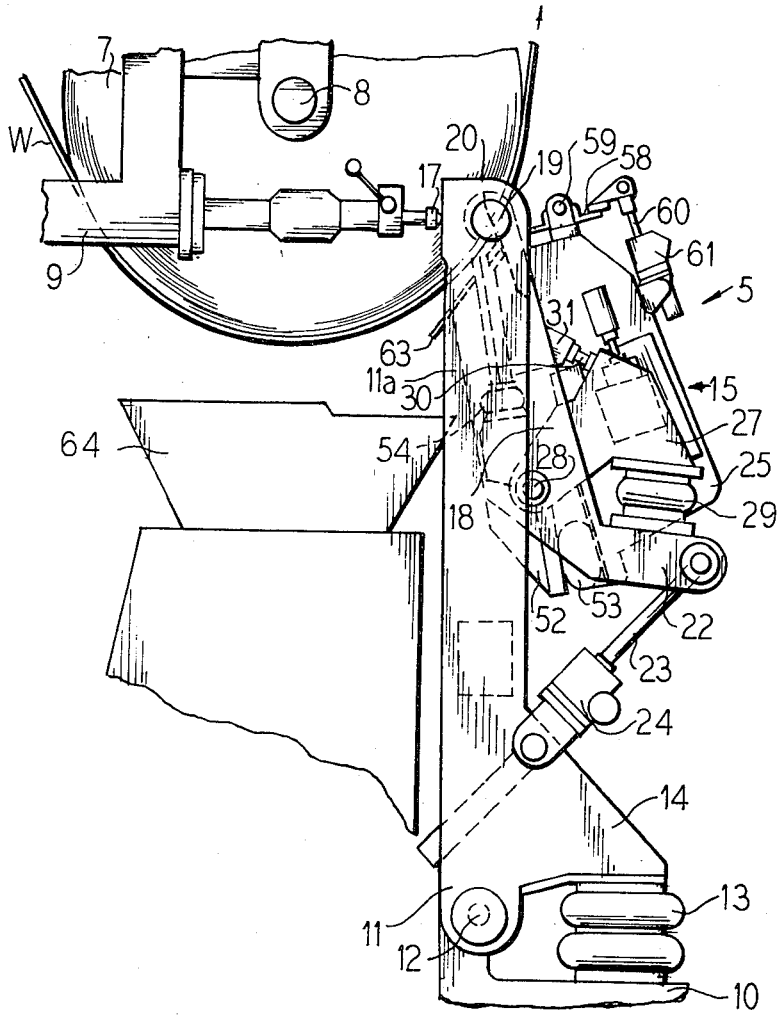
FIG. 1
FIG. 2
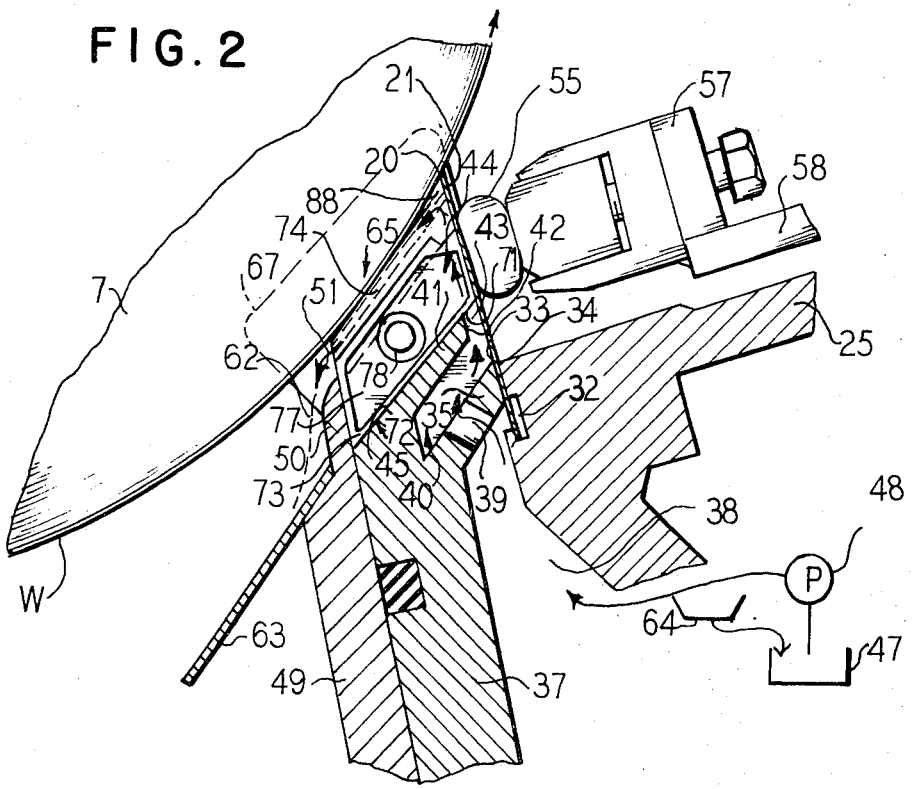

END DAM SEAL FOR BLADE TYPE FOUNTAIN COATERS

This invention relates to improvements in blade type fountain coaters which are especially suitable for applying coating materials to paper webs, and is more particularly concerned with novel end dam sealing means for such coaters.

Coating apparatus of the type with which the present invention is concerned is particularly adapted for so-called short-dwell coating by which maximum transfer of coating material from a suspension onto the surface of a continuously running web is attained, with minimum soaking of the material into the body of the web.

Basic principles of such apparatus have been disclosed in Nuebaur U.S. Pat. No. 3,348,526, and in a more recent, Damrau et al U.S. Pat. No. 4,250,211. According to the disclosures in those patents, which are incorporated herein by reference for more detailed explanation of the underlying principles and operation of the apparatus, coating material is supplied to and along a coating nip of a generally upwardly projecting doctor blade extending across the width of a web travelling continuously on backing surface means such as a roll.

Although U.S. Pat. No. 4,250,211 discloses, among other things, end dam sealing means, comprising felt, there has been some problem encountered with attaining sufficient sealing effect at the edges of the web and more particularly at the opposite ends of the coating applying pond chamber. The sealing means must not be loaded to apply too great pressure or there is tendency for coating material, which may migrate into the dynamic interfaces, to cause scoring or abrading and rapid wear. With light enough pressure loading at the interfaces to minimize wearing effect of migrating coating material, there is excessive leakage and thus fouling of the apparatus.

It is therefore an important object of the present invention to overcome certain disadvantages, drawbacks, inefficiencies, shortcomings and problems inherent in prior web coaters of the fountain type, and more particularly in the end dam sealing means for such coaters.

The present invention provides in a fountain coating applicator especially suitable for paper web coating and including a doctor blade projecting generally upwardly toward backing surface means, and having an upper edge for coating nip relation across the width of a web travelling continuously on said backing surface means; and means extending across at least the width of the web for supplying coating material under hydraulic pressure to said coating nip and including a coating application chamber defined in part by said doctor blade and said backing surface means, and in addition by an applicator chamber surface area spaced substantially below said nip, the improvement comprising end dam sealing means for at least one end of said application chamber, and adapted for engaging sealingly with said chamber surface area, said blade and said backing surface means; said end dam sealing means comprising a closed cell elastomer body having a seal surface sealingly engageable with said blade; and a wear resistant solid plastic sealing surface layer of substantial thickness carried by said body and having a face engageable with said backing surface means, said face having channel means therein between sealing surface land means for draining coating material migrating from said application chamber between said sealing means and said backing surface means.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure, and in which:

FIG. 1 is a fragmentary, more or less schematic, illustrative side elevational view of a coating apparatus embodying the invention;

FIG. 2 is a substantially enlarged fragmentary vertical sectional detail view showing how an embodiment of the end dam seal means cooperates with other elements of the coating applicator;

Figure 3:
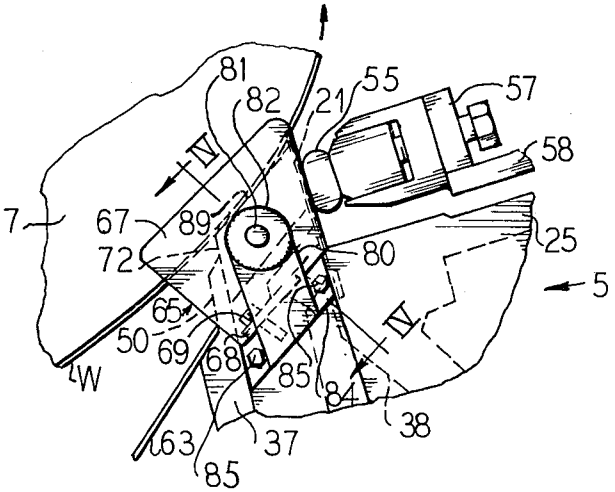
FIG. 3 is a view similar to FIG. 2, but showing an end elevation of the end dam seal means.

A blade type fountain coater apparatus 5, embodying the invention, is adapted to be properly related for applying coating material as a suspension to a web W such as paper travelling continuously on backing surface means conveniently in the form of a rotary back-up roll 7, which preferably has an elastic perimeter. Journal means 8 rotatably support the roll 7 in a machine frame 9, and suitable means (not shown) drive the roll at a desirable peripheral speed. Mounting of the coater 5 is on a base 10 to which an upstanding coater frame 11 is mounted by pivot means 12. Air spring means 13 thrust upwardly under rearwardly projecting rocker arm means 14 integral with the lower part of the frame 11, thus being adapted to maintain the upper part of the frame 11, carrying a coater head structure 15, in a desirably adjusted relation to the lower portion of the uprunning side of the backing roll 7. An adjustable stop 17, carried by the machine frame 9, acts to adjustably fix an optimum primary adjustment of the coater relative to the roll 7, and more particularly to the web W travelling therewith, at the critical coating zone. It will be understood that the coater frame 11 may comprise a pair of upstanding arms **11*a* spaced apart and adapted to accomodate the coater head 15 in supported relation therebetween, the left hand arm 11*a* being shown in FIG. 1** while a like arm is located on the opposite side of the apparatus.

Mounting of the coater head 15 on and between the frame arms **11*a* is desirably by means of depending substantially dog-leg side arms 18, one at each side of the coater head and which at upper ends thereof are respectively connected by aligned axes pivot means 19 to the inner side of the respectively associated arm 11*a*. The axes of the pivots 19 are desirably oriented by adjustment of the coater frame 11 to be aligned with a coating nip 20 (FIG. 2) defined in cooperation with the roll 7 by the upper edge of an upwardly projecting resiliently flexible doctor blade 21 supported by the coater head 15. At their lower ends, the arms 18 have rearward extensions 22 to which are connected respective adjustable links 23 extending diagonally downwardly toward with ends connected pivotally to the respective coater frame arms 11***a*. Servo motor means 24 are adapted for adjustments of the coater head by actuating the links 23.

The coater head 15 comprises a hollow rigid beam body 25 preferably of a length at least equal to the length of the roll 7. Mounting of the body 25 adjustably on and between the arms 18 is effected by means of a pair of side arms 27 having forwardly projecting portions attached by pivot means 28 to the respective inner sides of the side arms 18. Thereby swinging adjustments of the head 15 toward and away from the coating nip relation to the roll 7 are adapted to be effected, by air spring means 29 operably located on and between the arm extensions 22 and the arms 27. Adjustable stop means 30 between upper portions of the arms 27 and suitable abutment means 31 on the respectively adjacent support arms 18 maintain a desired yieldable operating adjustment of the body 25 about the pivot means 28.

Desirably the doctor blade 21 is of substantially the same length as the backing roll 7 and is mounted, as shown (FIG. 2) at a diagonal upward and inward angle toward the coating nip 20, and has its lower edge supported on a seat 32 provided by the upper portion of the body 25 nearest the coating zone. From the seat 32, the blade 21 projects upwardly past a blade clamping surface 33 adjacently above the seat 32 and leaving the major width of the blade extending freely upwardly. A selectively separable blade clamping surface 34 complementary to and cooperating with the clamping surface 34 is provided by means of a lip flange 35 on the upper portion of a clamping member plate 37, which is mounted in such a manner that the body 25 and the plate 37 can be separated from one another for ready access to the doctor blade mounting for assembling or replacing the doctor blade 21 and also for cleaning a coating material supply chamber 38 defined by and between the head body 25 and the plate 37 below the flange 35. A plurality of spaced pressure drop ports 39 through the flange 35 provide pressure drop communication between the chamber 38 and a mixing chamber 40 defined between the partition provided by the flange 35 and an overhanging spaced lip flange 41 at the top of the plate 37. An edge surface 42 of the flange 41 is in spaced opposition to the doctor blade 21 and define therewith a pressure drop slit orifice 43 communicating with a coating material application chamber 44 defined in part by the doctor blade 21 at the downstream side of the chamber 44 having regard to the machine direction, and located between the roll 7 and the web W thereon at the top of the chamber and a crown surface 45 providing a chamber floor spaced below the web on the upper end of the plate 37. Coating material is supplied under desirable hydraulic pressure from a source 47 by means of a pump 48 under desirable hydraulic pressure to the chamber 38 from which the coating material, by successive pressure drops through the ports 39 and the orifice 43, reaches the chamber 44 and is, in effect, extruded through the orifice 43 uniformly to the coating nip 20 for optimum coating results.

For maintaining adequate coating material pressure in the chamber 44, adjustable metering means comprising a metering plate 49 provides an upwardly projecting metering tip 50 along the upstream side of the chamber 44. Desirably the plate 49 is slidably mounted along the adjacent face of the plate 37 and, by adjusting the metering plate 49 in an up and down relation, the width of a metering or spillway orifice 51 between the upper edge of the tip 50 and the web W is adjustable for controlling pressure head in the chamber 44.

Both of the plates 37 and 49 are carried by an arm member 52 joined with the body 25 on the pivot 28 whereby relative swinging of the body 25 and the arm 52 about the pivot 28 enables opening and closing of the chamber 38 and the upper portions of the body and arm relative to the blade 21. Means for controlling the relative disposition of the body 25 and the arm 52 may comprise an inflatable tube 53 mounted between lower confronting portions of the body 25 and the arm 52. Suitable servo motor means 54 may be provided for slideably shiftably adjusting the height of the metering plate 49 and thus adjusting the width of the orifice 51.

For accurately controlling and maintaining the applicator nip 20, an adjustable thruster 55 bears against the face of the doctor blade 21 outside of the chamber 44. A head 57 supports the thruster 55 and is carried by a rocking lever 58 mounted on a rocker pivot 59 and rockably adjustable by means of a link 60 and servo device 61 for orienting the thruster 55 up and down along the blade 21 for controlling the slit orifice 43 by flexing of the doctor blade.

Surplus coating material which spills through the orifice 51 is guided by a baffle 63 (FIGS. 1 and 2) carried by and projecting from the upper portion of the metering plate 49 adjacent the base of the metering tip 50, into a pan type collector 64. Recirculation of the thus collected coating material may be effected by returning the same from the collector 64 to the source reservoir 47.

Figure 4:
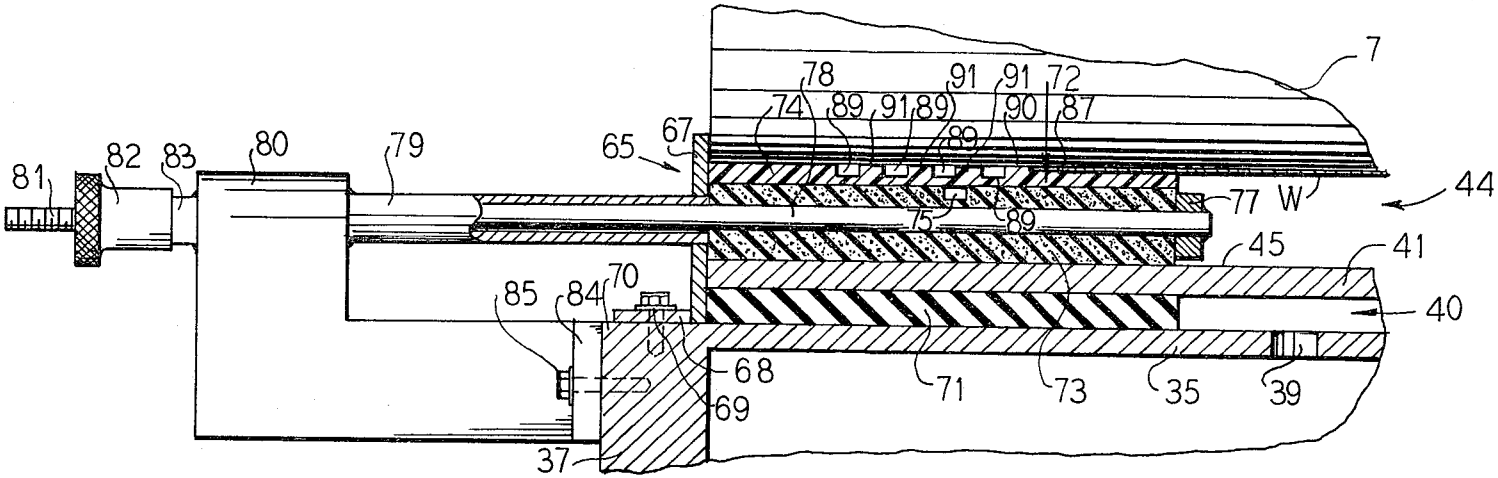
FIG. 4 is an enlarged sectional elevational view taken substantially along the line IV—IV of FIG. 3.

According to the present invention, new and improved end dam means 65 (FIGS. 2–4) are provided for sealing the ends of the chambers 40 and 44. To this end, a respective end dam plate 67 is mounted across the opposite ends of the chambers 40 and 44 and extends into partially lapping relation to the adjacent respective end of the roll 7 in each instance. Mounting of each of the dam plates 67 is desired by means of an integral right angular base flange 68 secured as by means of a screw 69 to a shoulder 70 on the plate 37 and which may be substantially aligned with the top of the partition flange 35 and extends beyond the end of the distribution and pressure drop chamber 40 and the end of the flange 41 so that the plate 67 serves as a closure for the end of the chamber 40 as well as the chamber 44 and confronts the end of the flange 41. Further, as best seen in FIGS. 2 and 3, the side edge portions of the plates 67 nearest the doctor blade 21 lap across the respective ends of the blade.

Each opposite end of each of the chambers 40 and 44 is provided with sealing dam means in addition to and cooperating with the contiguous plate 67 for efficiently retaining and directing the coating material to the surface of the web W running on the roll 7 as well as to avoid pressure loss and leakage from the ends of the chambers 40 and 44. To this end, a sealing member 71 is provided shaped to fit and fill the volume of the chamber 40 and with an extension projecting sealingly into the slit orifice 42 and has the top of the extension into the orifice 43 substantially in a plane with the top surface 45 of the plate 37 (FIG. 2). In length, the seal member 71 is desirably about equal to the length of a companion compressibly elastic seal member 72 which is constructed and arranged to substantially fill the chamber 44 adjacent to the respectively contiguous end dam plate 67. As best observed in FIG. 4, the seal members 71 and 72 are of a length which is substantially short of the nearest port 39 but extend inwardly relatively to the adjacent margin of the web W which preferably extends short by a desirable distance from the adjacent end of the backing roll 7 so that the seal member 72 overlaps the web margin. Through this arrangement, the seal member 71 provides a static seal because all of the surfaces sealed thereby are stationary. On the other hand, the seal 72 comprises a dynamic seal because the web W and the roll 7 are in motion relative thereto in operation of the coating apparatus.

In a preferred construction, the seal 72 is adapted for pressing sealingly toward the contiguous chamber surface area 45, the blade 21 and the backing surface roll 7, and means are provided for draining coating material that may migrate from the chamber 44 between the seal 72 and the roll 7. To this end, the seal 72 comprises a compressibly elastic body 73 and a dynamic sealing wear resisting layer 74. Desirably, the body 73 is made from closed cell sponge rubber, such as neoprene, urethane, or the like. The layer 74 desirably comprises a highly wear resistant material such as nylon, glass filled tetrafluoroethylene, or the like. The body 73 and the layer 74 are suitably bonded to one another. Further, desirably at least one keying lug 75 projects from the interface of the layer 74 into the body 73 and extends in a direction across the length of the member 72. In its normal shape, the sealing member 72 is adapted to be received freely in the area which it occupies in the chamber 44. But by virtue of the substantial length of the member and the compressible character of the body 73, endwise compression of the member is adapted to cause transverse expansion in all directions about the member so that a desirable, preferably light, pressing sealing engagement of the member with the several surfaces engaged thereby is attained, and including the chamber surface area 45, the blade 21, the backing surface roll 7, and the metering plate tip 50. The compressible and expansible characteristics of the member 72 maintains a fairly uniform contact with all sealingly engaged surfaces while permitting substantial initial tolerances, and permits substantial adjustments of the head 5 and the blade 21 to be made relative to the backing roll 7.

Means for adjustably applying compression endwise to the member 72 comprise a compression applicator plate 77 (FIGS. 2 and 4) which engages the inner end of the member 72, and more particularly the inner end of the body 73. Fixed to the plate 77 and extending freely longitudinally through the body 73 is a control rod 78 which extends to a substantial length outwardly through the dam plate 67 and a protective sheathing tube 79 and a supporting bracket member 80, with a threaded distal end portion 81 of the rod threadably engaged by a thumb screw member 82 which slidably abuts a shoulder 83 on the bracket 80. Mounting of the bracket 80 is desirably onto the outer side of the plate 37 to which attachment flange means 84 may be secured as by screw means 85. Through this arrangement, by manipulation of the adjustment nut 82, the seal member 72 is adapted to be compressed endwise toward the dam plate 67 and thus stressed to expand into sealing engagement with the surrounding surfaces within the chamber 44.

In a preferred arrangement, the side edges of the web W extend short of the ends of the backing roll 7, and the dynamic sealing wear layer 74 engages in overlapping relation to the adjacent web sheet margin and also engages sealingly with the roll 7 between its end and the edge of the web. To permit fairly snug sealing engagement of the sealing layer 74 with the surface of the roll 7 without pressing with undesirable pressure against the overlapped surface of the running web W, a shallow uniform recess 87 of a depth about equal to the web thickness is provided in the dynamic sealing surface of the layer 74 and of a width somewhat greater than the anticipated extent of the web edge to afford ample web edge variation tolerance. Thereby, when the seal body 73 is placed under compression and causes sealing expansion of the member 72, the dynamic sealing layer 74 will be substantially uniformly compressed with the desired light sealing pressure against both the engaged margin of the web W and the engaged area of the roll 7 outwardly beyond the edge of the web. Since the principal working region within the chamber 44 is in the vicinity of the coating nip 20, and toward which coating material pressure is focused, the sealing member 73 is provided with a nose portion 88, preferably on the layer 74, which fits firmly under compressive adjustment of the member 72 into the triangular convergence of the roll 70 and the blade 21 toward the nip 20. This maintains a uniform concentration of the uniformly distributed coating material toward the coating nip 20.

Coating material pressure in the chamber 44 may be in the order of from $\frac{1}{4}$ psi to 1 psi. At this pressure, leakage past the static sealing surfaces of the sealing member 72 is practically precluded even though the sealing pressure may be applied fairly lightly by compression and expansion of the seal body 73. At the dynamic sealing surface provided by the seal layer 74, outward migration will occur even at the relatively low coating material pressure, with beneficial effect along the margin of the web lapped by the layer 74 within the groove 87. The migrating coating material not only provides lubricity but also coats the web margin. However, outwardly beyond the web edge, lubricity is desirable but stagnation of migrating coating material is undesirable and leakage beyond the outer end of the seal should be avoided. Means are therefor provided for draining the migrating coating material beyond the groove 87, herein comprising at least one, and preferably a plurality of spaced drainage channels 89 with a land 90 separating the groove 87 from the adjacent channel 89, and with respective lands 91 separating the channels one from the other. Each of the channels 89 and the lands 90 and 91 extend throughout the width of the dynamic sealing surface layer 74. At their downstream ends, the channels 89 are contiguous to the nip 20. At their upstream ends, the channels 89 are open for drainage through the spillway orifice 51 above the metering tip 50. Migration of coating material from the groove 87 across the land 90 into the adjacent channel 89 provides lubricity between the land 90 and the engaged surface of the roll 7, but is received in the channel with a pressure drop. Since the channels 89 are of limited cross sectional flow area, and the volume of coating material is supplied to the chamber 44 under continuous hydraulic pressure, there will be migration across each of the succeeding lands 91 successively into the series of channels 89 with successive pressure drops so that in the last in the series of channels 89, while there may be sufficient liquid for libricity carried into the outermost dynamic sealing surface interface between the layer 74 and the roll 7, very little, if any, of the solids in the coating material suspension will carry over into the final endmost area by lack of hydraulic pressure. By reason of the flow across the lands 90 and 91, the areas of the lands are flushed continuously free from any of the coating material solids that might otherwise tend to stagnate and cause abrasion of the surface of the roll 7.

On reference to FIGS. 5–7, coater apparatus 5' embodies structure substantially the same as the coater apparatus 5 of FIGS. 1–4, except that a modified form of end dam means 92 embodying the invention are provided for sealing the ends of the chamber 40 and 44 which are the same and function the same as already described in connection with FIGS. 1–4. Reference numerals which are common to FIGS. 1–4 and FIGS. 5–7 designate similar parts and therefore the description will not be repeated at this point.

Figure 7:
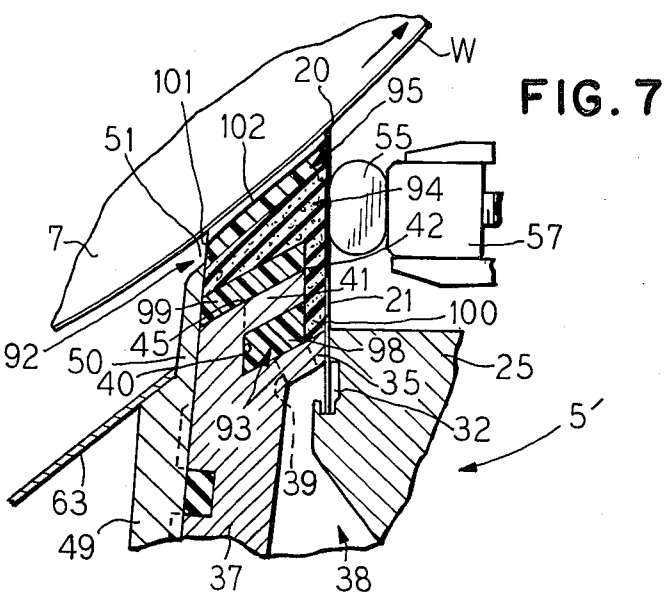
FIG. 7 is a sectional detail view taken substantially along the line VII—VII in FIG. 6.
Figure 6:
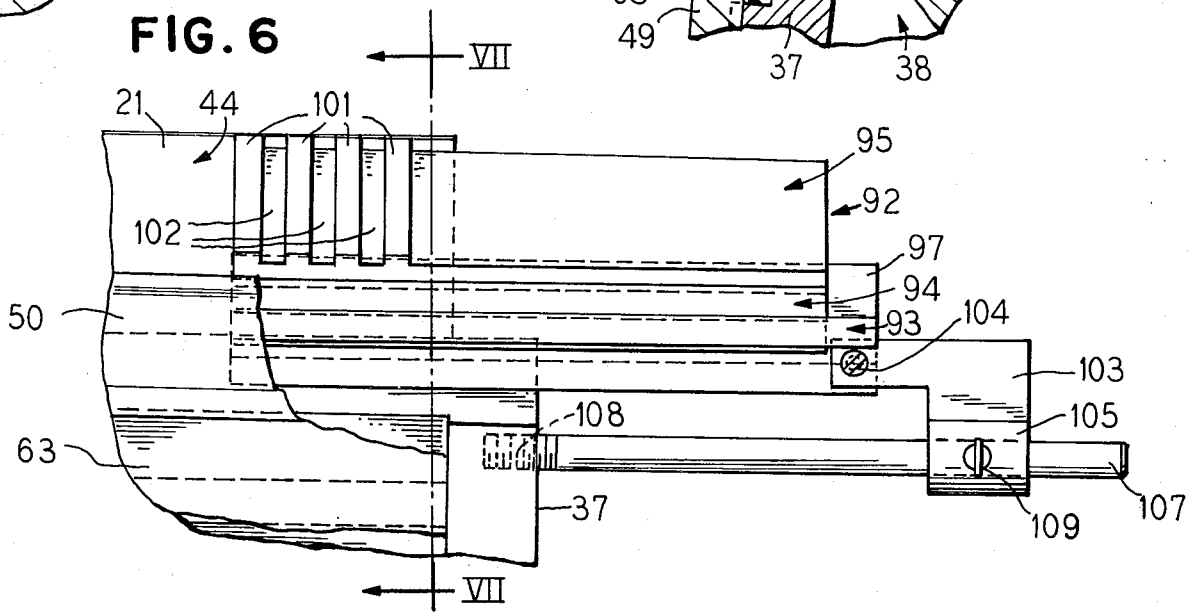
FIG. 6 is a fragmentary elevational view taken substantially in the plane of line VI—VI in FIG. 5.
Figure 5:
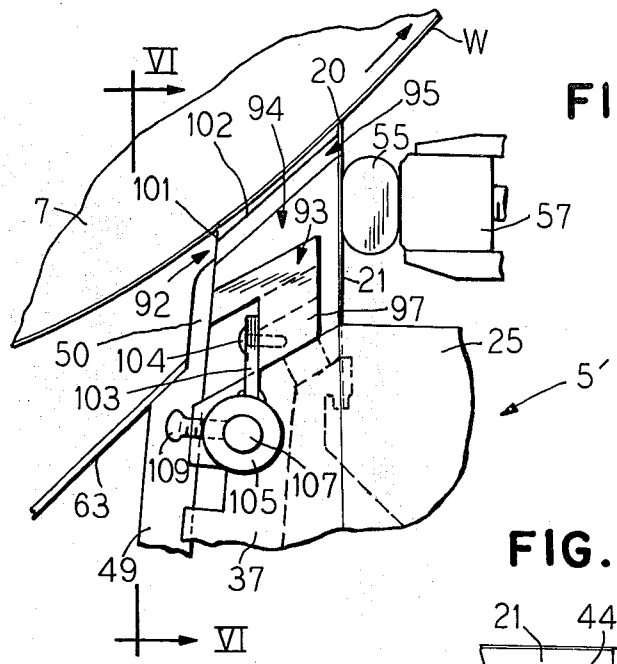
FIG. 5 is a view similar to FIG. 2 but showing another embodiment of the invention.

Similarly as described in respect to the end dam sealing means 65, each end of each of the chambers 40 and 44 in FIGS. 5–7 is provided with the end dam sealing means 92, which at each such end is constructed and arranged to be complementary to the parts of the apparatus with which functionally oriented. In a convenient construction, each of the end dam means 92 comprises three sealing elements which are attached to one another so that the assembly comprises a unitary seal, namely a solid plastic base member 93 carrying a close cell elastomer member 94 on which is mounted a solid elastomer member 95. All of the members 93, 94 and 95 are separately fabricated and then assembled and bonded together in any suitable fashion, such as by adhesive means, and form a unitary sealing structure.

In addition to serving as a base support for the other members of the sealing unit, the member 93 is constructed and arranged to provide a primary seal for the chamber 40 and a part of the seal for the chamber 44. To this end, the member 93 is desirably molded in ultra-high molecular weight polyethylene and comprises a head end portion 97 from which extends a pair of spaced parallel elongated seal portions 98 and 99 having a slot therebetween receptive of the overhanging lip flange 41. The portion 98 is of cross-section complementary to and adapted to fill the respective end of the chamber 40 between the flanges 35 and 41. The portion 99 is adapted to overlie the top surface 45 on the flange 41 and the clamping member plate 37. At the faces of the portions 98 and 99 nearest the doctor blade 21, such surfaces lie in a plane with the edge surface 42 of the flange 41.

A function of the seal element 94 is to provide a resilient body support for the member 95 and to provide a seal for the associated end of the orifice defined between the edge 42 and the doctor blade 21. To this end, the member 94 is desirably molded from a closed cell elastomer such as expanded closed cell neoprene sponge. A depending flange 100 on the member 94 sealingly fills the space between the doctor blade 21 and the confronting edges of the flanges 41, 98 and 99. The main body of the seal element 94 is shaped to overlie the full extent of the seal flange 99 and to extend upwardly therefrom and above the flange 100 to cooperate supportingly with the seal element 95 and to provide a major sealing surface in engagement with the doctor blade 21 along a common face with the flange 100.

In a preferred construction, the seal element 95 comprises a panel which lies atop and is secured to the body element 94, the particular relationship being such that the element 95 will engage in complementary dynamic sealing relation with the periphery of the roll 7; and will statically seal the area of the doctor blade 21 from the static sealing face of the seal element 94 to the coating nip 20. For best results, the seal element 95 is made from a suitable low friction plastic material such as polytetrafluorethylene, available on the market as Teflon.

Preferably, the length of the seal element 95 is common to the length of the element 94 and common to the length of the element 93 inwardly from the head 97, as best seen in FIG. 6. At their face surfaces remote from the doctor blade 21, the seal elements 93, 94 and 95 are in a common plane with the underlying vertical surface of the plate 37 and the confronting surface of the metering plate 49 and more particularly the tip 50 which defines with its top edge and the web W the metering or spillway orifice 51. Thereby the metering plate 49 can be readily adjusted vertically along the contiguous faces of the plate 37 and the seal assembly 92.

An especially desirable construction of the seal layer or element 95 provides for dynamic sealing against any substantial leakage from the coating chamber 44 past the back-up member roll 7 while nevertheless permitting some migration of coating material sufficient for lubricity to avoid or at least minimize wear of the dynamically engaged surfaces at the interfaces of the seal and the roll, but avoiding stagnation of migrating coating material. For this purpose, the element 95 is provided with alternate sealing land and drainage channel means comprising in a preferred arrangement a plurality of spaced lands 101 and intervening channels 102 extending in the direction of backing roll travel and located preferably on the inner end portion of the element 95. At its inner end the seal element 95 approaches but desirably does not contact the edge of the web W. Outwardly from the lands 101, the remainder of the length of the upper surface of the seal element 95 may be in a common plane with the roots of the channels 102. Each of the seal lands 101 has its top surface desirably substantially conformed to the radius of curvature of the perimeter of the back-up roll 7 for efficient dynamic sealing engagement therewith. Each of the channels 102 desirably extends throughout the width of the dynamic sealing element 95. At their ends nearest the doctor blade 21, the channels 102 open generally toward the nip 20 and the ends of the lands 101 effect static sealing engagement with the blade 21. At their opposite ends, the channels 102 open for drainage through the spillway orifice 51 above the metering tip 50. Migration of coating material from the chamber 44 past the dynamic sealing surface of the innermost of the lands 101 not only provides lubricity for that land but is received with pressure drop into the adjacent channel 102. By reason of the limited cross sectional flow area of the channels 102 and the volume and pressure of the coating material supplied to the chamber 44 under continuous hydraulic pressure, there can be expected to be migration across each of the succeeding lands 101 into the succeeding channels 102 with successive pressure drops progressively outwardly. In the last in the series of the channels 102 there may be sufficient liquid for lubricity carried over onto the last of the lands 101, and if any of the solids of the coating material remain to be carried onto the sealing surface of the outermost of the lands 101, it will be flushed away to the remaining surface outwardly therefrom on the seal element 75. Any such final migration of the sealing material will, however, be quite minimal.

To permit adjustment of the end dam seal 92 at each end of the coating puddle structure defined by the upper end portion of the plate 37 in cooperation with the doctor blade 21 and the backing member 7, and having regard to the width of the web to be coated, the end seal, in each instance, is mounted for selective longitudinal adjustment. In a practical arrangement, a bracket member 103 is secured as by means of a screw 104 to the head 97 of the seal element 93 and has attached thereto a bushing 105 slidable adjustably engaged about a control rod 107 extending outwardly from and having its inner end secured as by means of threaded engagement at 108 with the adjacent outer side of the plate 37. Means such as a thumb screw 109 carried by the sleeve or bushing 105 is adapted to lock the seal assembly in any desired adjusted position along the length of the rod 107. This greatly facilitates making quick and accurate adjustments of the end seal 92 relative to the web width.

It will be appreciated that by virtue of the enclosed cell resilience of the seal body element 94, adjustments of the doctor blade 21 by means of the thruster 55 are readily accommodated. Also, self-adjustment of the dynamic sealing element 95 relative to the perimeter of the back-up roll 7 is facilitated by the resiliency of the element 94. Such resiliency also provides a substantially take up spring effect for the end seal 92 relative to the sealingly engaged surfaces.

It will be understood that variations and modifications may be effected without departing from the spirit and scope of the novel concepts of this invention.

I claim as my invention:

1. In a fountain coating applicator especially suitable for paper web coating and including a doctor blade projecting generally upwardly toward backing surface means, and having an upper edge for coating nip relation across the width of a web travelling continuously on said backing surface means; and means extending across at least the width of the web for supplying coating material under hydraulic pressure to said coating nip and including a coating application chamber defined in part by said doctor blade and said backing surface means, and in addition by an application chamber surface area spaced substantially below said nip, the improvement comprising:

end dam sealing means for at least one end of said application chamber, and adapted for engaging sealingly with said chamber surface area, said blade and said backing surface means;

said end dam sealing means comprising a closed cell elastomer body having a sealing surface sealingly engageable with said blade;

and a wear resistant solid plastic sealing surface layer of substantial thickness carried by said body and having a face engageable with said backing surface means, said face having channel means therein between sealing surface land means for draining coating material migrating from said application chamber between said sealing means and said backing surface means.

2. A fountain coating applicator according to claim 1, wherein said channel means for draining extends in the direction of web travel and has a downstream end adjacent to said coating nip and an upstream end discharging through a discharge opening from said chamber.

3. A fountain coating applicator according to claim 2, including means defining a discharge metering orifice from said chamber upstream relative to said coating nip, and said channel means opening at its upstream end to said metering orifice.

4. A fountain coating applicator according to claim 1, wherein said layer provides a nose on said body extending to said coating nip.

5. A fountain coating applicator according to claim 1, wherein said web extends along its edge short of an adjacent end of said backing surface means, said layer having a shallow groove therein accomodating the thickness of a marginal portion of said web, and surface of the layer beyond said web edge engaging said backing surface means and having said channel means for draining coating material.

6. A fountain coating applicator according to claim 5, wherein said channel means for draining coating material extends in the direction of travel of the web, and a land of said layer intervens between said channel means and said groove, and across which land coating material is adapted to migrate with pressure drop into said channel.

7. A fountain coating applicator according to claim 1, wherein said layer has a plurality of similar drainage channels spaced apart by narrow land areas of said layer, and said coating material being adapted to migrate across said land areas successively by pressure drops into the channels.

8. A fountain coating applicator according to claim 1, wherein said coating material supplying means includes a pressure drop chamber communicating in coating material supplying relation with said application chamber through a coating material extrusion slit orifice directing coating material toward said coating nip, and end dam sealing means in said pressure drop chamber generally aligned with said end dam sealing means in said application chamber and having extension sealing means projecting sealingly into the adjacent end of said extrusion orifice.

9. A fountain coating applicator according to claim 1, wherein said coating material supplying means includes a pressure drop chamber communicating in coating material supplying relation with said application chamber through a slit coating material extrusion orifice directed toward said coating nip, and said end dam sealing means is adapted to seal an end of said extrusion orifice as well as said pressure drop chamber in addition to said application chamber.

10. A fountain coating applicator according to claim 1, wherein said end dam sealing means comprises a sealing assembly having head means adjacent to said one end of said application chamber, and means for effecting endwise adjustment of said sealing assembly rectilinearly in inward and outward directions relative to said end of said application chamber and including a bracket attached to said head means and carried in guided engagement with a guide rod, with means for securing said bracket in selected adjusted positions along said rod.

11. A fountain coating applicator according to claim 1, wherein said coating material supplying means includes a pressure drop chamber communicating in coating material supplying relation with said application chamber through a slit extrusion orifice directed toward said coating nip, and said end dam sealing means includes a sealing device sealing an end of said pressure drop chamber and said closed cell elastomer body having a portion in sealing relation to the adjacent end of said slit extrusion orifice.

12. In a fountain coating applicator especially suitable for paper web coating and including a doctor blade projecting generally upwardly toward backing surface means, and having an upper edge for coating nip relation across the width of a web travelling continuously on said backing surface means; and means extending across at least the width of the web for supplying coating material under hydraulic pressure to said coating nip and including a coating application chamber defined in part by said doctor blade and said backing surface means, and in addition by an application chamber surface area spaced substantially below said nip, and comprising:

said coating material supply means being in the form of a chamber below said application chamber surface area and communicating in coating supply relation with said application chamber through a coating material extrusion slit orifice defined by and along said blade and an adjacent edge of said chamber surface area for directing coating material toward said coating nip;

end dam sealing means for at least one end of said application chamber and adapted for engaging sealingly with said chamber surface area, said blade and said backing surface means;

said end dam sealing means comprising an elastic body having a sealing surface sealingly engageable with said blade and a sealing face engageable with said backing surface means, said face having means for controlling migration of coating material thereacross from said application chamber; and an end sealing member in the end of said supply means chamber adjacent to said one end of said application chamber and provided with a sealing extension projecting into the adjacent end of said orifice.

13. A fountain coating applicator according to claim 12, wherein said means for controlling migration comprising at least one channel in said sealing face.

14. In a fountain coating applicator especially suitable for paper web coating and including a doctor blade projecting generally upwardly toward backing surface means, and having an upper edge for coating nip relation across the width of a web travelling continuously on said backing surface means; and means extending across at least the width of the web for supplying coating material under hydraulic pressure to said coating nip and including a coating application chamber defined in part by said doctor blade and said backing surface means, and in addition by an application chamber surface area spaced substantially below said nip, and comprising:

said coating material supply means being in the form of a chamber below said application chamber surface area and communicating in coating supply relation with said application chamber through a coating material extrusion slit orifice defined by and along said blade and an adjacent edge of said chamber surface area for directing coating material toward said coating nip;

end dam sealing means for at least one end of said application chamber and adapted for engaging sealingly with said chamber surface area, said blade and said backing surface means;

said end dam sealing means comprising an elastic body having a sealing surface sealingly engageable with said blade and a sealing face engageable with said backing surface means, said face having means for controlling migration of coating material thereacross from said application chamber; and said elastic body having an extension therefrom projecting into said sealing engagement within the end of said orifice adjacent to said one end of said application chamber.

15. A fountain coating applicator according to claim 14, including an end sealing member in the end of said supply means chamber adjacent to said one end of said application chamber fabricated independently from said elastic body and fixedly secured in unitary relation to said elastic body.

16. A fountain coating applicator according to claim 15, wherein said end sealing member includes a portion extending between said elastic body and said chamber surface area and affixed to said elastic body including said extension.

17. A fountain coating applicator according to claim 14, including a solid wear resisting layer carried by said elastic body and providing said face for engaging said backing surface means, said layer comprising an independently fabricated element permanently affixed to said elastic body.

18. A fountain coating applicator according to claim 17, including a sealing element for the end of the supply means chamber adjacent to said one end of said application chamber and attached in a unit with said elastic body.

19. A fountain coating applicator according to claim 14, including an end sealing element for the end of said supply chamber means adjacent to said one end of said application chamber, said element being permanently attached to said elastic body and having head means located outwardly from said ends, and means attached to said head for effecting rectilinear adjustments of said body and element relative to said ends.

20. A fountain coating applicator according to claim 19, wherein said means for effecting adjustment comprises a bracket attached to said head, a control rod adjustably engaged by said bracket, and means for selectively securing said bracket in adjusted positions along said rod.

* * * * *